US011480182B2

(12) United States Patent
Ohtachi et al.

(10) Patent No.: US 11,480,182 B2
(45) Date of Patent: Oct. 25, 2022

(54) VACUUM PUMP, CYLINDRICAL PORTION USED IN VACUUM PUMP, AND BASE PORTION

(71) Applicant: Edwards Japan Limited, Chiba (JP)

(72) Inventors: Yoshinobu Ohtachi, Chiba (JP); Yasushi Maejima, Chiba (JP); Tsutomu Takaada, Chiba (JP)

(73) Assignee: Edwards Japan Limited, Chiba (JP)

( * ) Notice: Subject to any disclaimer, the term of this patent is extended or adjusted under 35 U.S.C. 154(b) by 0 days.

(21) Appl. No.: 17/265,373

(22) PCT Filed: Aug. 2, 2019

(86) PCT No.: PCT/JP2019/030617
§ 371 (c)(1),
(2) Date: Feb. 2, 2021

(87) PCT Pub. No.: WO2020/031927
PCT Pub. Date: Feb. 13, 2020

(65) Prior Publication Data

US 2021/0293244 A1 Sep. 23, 2021

(30) Foreign Application Priority Data

Aug. 8, 2018 (JP) ..... JP2018-149485

(51) Int. Cl.
*F04D 19/04* (2006.01)
*F04D 29/18* (2006.01)
*F04D 29/52* (2006.01)

(52) U.S. Cl.
CPC ..... *F04D 19/042* (2013.01); *F04D 29/181* (2013.01); *F04D 29/522* (2013.01)

(58) Field of Classification Search
CPC ..... F04D 19/04; F04D 19/042; F04D 29/522; F04D 29/64
See application file for complete search history.

(56) References Cited

U.S. PATENT DOCUMENTS 7,572,096 B2 * 8/2009 Nonaka ..... F04D 29/023 415/90
8,246,300 B2 * 8/2012 Shi ..... F04D 19/042 415/199.5

(Continued)

FOREIGN PATENT DOCUMENTS

DE 102008058149 A1 5/2010
EP 0829645 A2 * 3/1998 ..... F04D 19/042

(Continued)

OTHER PUBLICATIONS

PCT International Search Report dated Oct. 29, 2019 for corresponding PCT application Serial No. PCT/JP2019/030617, 2 pages.

(Continued)

*Primary Examiner* — Topaz L. Elliott
*Assistant Examiner* — Jackson N Gillenwaters
(74) *Attorney, Agent, or Firm* — Theodore M. Magee; Westman, Champlin & Koehler, P.A.

(57) ABSTRACT

Provided is a vacuum pump including a turbomolecular mechanism having rotor blades and stator blades alternately arranged in multiple stages in an axial direction inside a casing having an inlet port that sucks gas from an outside and an outlet port that exhausts the sucked gas to the outside, the vacuum pump including: a plurality of annular spacers that are stacked on each other and position the stator blades in the axial direction; the casing that has a cylindrical portion arranged to surround outer peripheries of the plurality of stacked spacers and a base portion attached to a lower portion of the cylindrical portion; and an upper radial positioning portion and a lower radial positioning portion provided at two vertical positions inside the cylindrical portion and coaxially hold at least a spacer of an uppermost stage and a spacer of a lowermost stage among the plurality of stacked spacers.

7 Claims, 9 Drawing Sheets

(56) References Cited

U.S. PATENT DOCUMENTS

| | | | | |
|---|---|---|---|---|
| 8,366,380 | B2 * | 2/2013 | Sakaguchi | F04D 29/644 415/90 |
| 8,591,204 | B2 * | 11/2013 | Yamaguchi | F04D 29/644 417/423.4 |
| 2013/0121858 | A1 * | 5/2013 | Sekita | F04D 29/644 417/423.12 |
| 2016/0025096 | A1 * | 1/2016 | Shi | F04D 25/06 417/423.1 |

FOREIGN PATENT DOCUMENTS

| | | | |
|---|---|---|---|
| JP | S6077795 | | 5/1985 |
| JP | H11230084 | A | 8/1999 |
| JP | 2000205183 | A | 7/2000 |
| JP | 2002070787 | A | 3/2002 |
| JP | 2003262198 | A | 9/2003 |
| JP | 2003269364 | A | 9/2003 |
| JP | 2005083271 | A | 3/2005 |
| JP | 2005240689 | A | 9/2005 |
| JP | 2007309245 | A | 11/2007 |
| JP | 2011074903 | A | 4/2011 |
| JP | 5115627 | B2 | 1/2013 |
| JP | 2017044185 | A | 3/2017 |

OTHER PUBLICATIONS

PCT International Written Opinion dated Oct. 29, 2019 for corresponding PCT application Serial No. PCT/JP2019/030617, 5 pages.
EP Communication dated Mar. 17, 2022 for corresponding European application Serial No. 19848544.3, 9 pages.

* cited by examiner

VACUUM PUMP, CYLINDRICAL PORTION USED IN VACUUM PUMP, AND BASE PORTION

CROSS-REFERENCE OF RELATED APPLICATION

This application is a Section 371 National Stage Application of International Application No. PCT/JP2019/030617, filed Aug. 2, 2019, which is incorporated by reference in its entirety and published as WO 2020/031927 A1 on Feb. 13, 2020 and which claims priority of Japanese Application No. 2018-149485, filed Aug. 8, 2018.

BACKGROUND

The present invention relates to a vacuum pump, a cylindrical portion used in the vacuum pump, and a base portion and, in particular, to a vacuum pump used in a semiconductor manufacturing device, an analyzing device, or the like, a cylindrical portion used in the vacuum pump, and a base portion.

In manufacturing semiconductor devices such as memories and integrated circuits, processing to deposit films such as an insulating film, a metal film, and a semiconductor film or etching processing is performed inside a highly-vacuumized process chamber in order to avoid influence by dust or the like in the air. For exhausting gas inside the process chamber, a vacuum pump such as a turbomolecular pump is, for example, used.

As such, there has been known a vacuum pump (see, for example, Japanese Patent Application Laid-open No. 2008-66327) including a gas transfer mechanism (turbomolecular mechanism) having rotor blades and stator blades that are alternately arranged in multiple stages in an axial direction inside a casing having an inlet port that sucks gas from an outside and an outlet port that exhausts the gas to the outside.

FIGS. 7 to 9 are views for illustrating the schematic structure of a conventional vacuum pump including a gas transfer mechanism having rotor blades and stator blades that are alternately arranged in multiple stages in an axial direction inside a casing. FIG. 7 is a vertical cross-sectional view of the vacuum pump. FIG. 8 is an enlarged view of an H-portion shown in FIG. 7. FIG. 9 is a cross-sectional view for illustrating an annular spacer that vertically positions a stator blade at a prescribed interval inside the casing.

First, in the conventional vacuum pump 100 shown in FIGS. 7 and 8, a casing 101 that forms the housing of the vacuum pump 100 forms the enclosure of the vacuum pump 100 with a cylindrical portion 102 and a base 103 provided beneath the cylindrical portion 102. In the casing 101, a gas transfer mechanism 104 that serves as a structure to cause the vacuum pump 100 to exhibit an exhausting function is accommodated.

The gas transfer mechanism 104 is roughly constituted by a rotor portion 105 that is rotatably supported and a stator portion 106 that is fixed to the casing 101.

The rotor portion 105 of the gas transfer mechanism 104 includes a shaft 107 that serves as a rotating shaft, a rotor 108 that is disposed on the shaft 107, and a plurality of rotor blades 109 that are provided on the rotor 108.

At a midpoint in the axial direction of the shaft 107, a motor portion 110 is provided and enclosed by a stator column 111. In addition, radial magnetic bearing devices 114 and 115 for supporting the shaft 107 in a radial direction in a non-contact manner are provided on the side of the inlet port 112 and the side of the outlet port 113, respectively, with respect to the motor portion 110 of the shaft 107 inside the stator column 111. Further, an axial magnetic bearing device 116 for supporting the shaft 107 in an axial direction in a non-contact manner is provided at the lower end of the shaft 107.

The stator portion 106 of the gas transfer mechanism 104 is formed on the inner peripheral side of the casing 101. In the stator portion 106, spacers 117 having a cylindrical shape and a plurality of stator blades 118 of which the interval in the axial direction is held by the spacers 117 are disposed. The stator blades 118 are disc-shaped planar members that perpendicularly radially extend with respect to an axial line O2 of the shaft 107.

The spacers 117 are stator members having a substantially cylindrical shape and extend along the axial direction of the casing 101. The spacers 117 include first radial supporting portions 117*a* that orbit and oppose the outer peripheral surfaces of the stator blades 118 and come into contact with the inner peripheral surface of the cylindrical portion 102 and second radial supporting portions 117*b* that orbit and oppose the outer peripheral surfaces of the rotor blades 109 and come into contact with the inner peripheral surfaces of the first radial supporting portions 117*a*.

Then, in the assembling of the stator blades 118 and the spacers 117 of the vacuum pump 100, the stator blade 118 of the lowermost stage is first placed on the base 103 after the rotor portion 105 is fixed onto the base 103, and the spacers 117 and the stator blades 118 are next alternately sequentially stacked on each other. At this time, the spacers 117 are stacked on each other in a state in which the stator blades 118 are accommodated in the inner peripheral surfaces of the first radial supporting portions 117*a* and the inner peripheral surfaces of the first radial supporting portions 117*a* are fitted and connected to the outer peripheral surfaces of small-diameter portions 117*c* that form step portions on the back surfaces (outer peripheral surfaces) of the second radial supporting portions 117*b*. Further, when this operation is repeatedly performed so as to interpose the rotor blades 109 between the stator blades 118 at the same time, the gas transfer mechanism 104 having the cylindrical stator portion 106 and the rotor portion 105 in which the rotor blades 109 and the stator blades 118 are alternately arranged in multiple stages in an axial direction is assembled and formed.

After the assembling of the stator portion 106, the casing 101 is put from above the side of the spacer 117 of the uppermost stage to accommodate the rotor portion 105 and the stator portion 106 in the casing 101. Thus, the gas transfer mechanism 104 is accommodated in the casing 101. Further, in the casing 101 that accommodates the gas transfer mechanism 104, a positioning portion 102*a* formed in a step shape at a portion of an upper inner peripheral surface in the cylindrical portion 102 comes into contact with the upper surface and the outer peripheral surface of the spacer 117 of the uppermost stage. Thus, positioning in an axial direction M and positioning in a width direction (thrust direction) R of the casing 101 and the gas transfer mechanism 104 are performed.

On the other hand, the lower portion of the casing 101 comes into contact with the place between the inner peripheral surface of the cylindrical portion 102 and the outer peripheral surface of the base 103 at a gap S1 across an O-ring 119 for sealing that is disposed inside an annular recessed groove 103*a* formed on the outer periphery of the base 103. Then, when the cylindrical portion 102 and the base 103 are fixed to each other by bolts 120, the casing 101 is integrated with the gas transfer mechanism 104.

Meanwhile, in the structure of the stator portion 106 in which the spacers 117 and the stator blades 118 are sequentially stacked on each other to have multiple stages like the vacuum pump 100 shown in FIGS. 7 and 8, the inclination of the gas transfer mechanism 104 with respect to an axial line O2, that is, movement (the deviation of the coaxiality) in a radial direction R of the gas transfer mechanism 104 becomes large toward an upper side when the spacers 117 and the stator blades 118 are stacked on each other if the processing accuracy of various dimensions A, B, and C of the spacers 117 shown in FIG. 9 is not high. Accordingly, each of the accuracy of the dimensions A, B, and C is required to be increased (tightened). Note that the dimension A represents the dimension of the inner peripheries of the first radial supporting portions 117*a*, the dimension B represents the dimension of the outer peripheries of the spacers 117, and the dimension C represents the dimension of the small-diameter portions (step portions) 117*c*.

The discussion above is merely provided for general background information and is not intended to be used as an aid in determining the scope of the claimed subject matter. The claimed subject matter is not limited to implementations that solve any or all disadvantages noted in the background.

SUMMARY

As described above, in the vacuum pump 100 shown in FIGS. 7 and 8, the positioning portion 102*a* that positions the stator portion 106 of the gas transfer mechanism 104 accommodated in the cylindrical portion 102 is provided only at one upper spot in the cylindrical portion 102 of the casing 101. Therefore, if the number of the stages of the stacked spacers 117 increases, the movement (the deviation of the coaxiality) in the radial direction R of the side of the stator portion 106 becomes large in proportion to the number of the stages. As a result, the operation of attaching the casing 101 to the stator portion 106 becomes difficult. Accordingly, since a dimensional tolerance in the processing of the spacers 117 is required to be tightened, the processing is difficult and a manufacturing cost increases.

A technological problem to be solved occurs in order to provide: a vacuum pump having a structure that allows the securement of the certain positioning accuracy of spacers and a reduction in a manufacturing cost for the vacuum pump even if a dimensional tolerance in manufacturing is loosened; a cylindrical portion used in the vacuum pump; and a base portion. The present invention has an object of solving the problem.

The present invention has been proposed to achieve the above object. An aspect of the present invention provides a vacuum pump including a turbomolecular mechanism having rotor blades and stator blades that are alternately arranged in multiple stages in an axial direction inside a casing having an inlet port for sucking gas from an outside and an outlet port for exhausting the sucked gas to the outside, the vacuum pump including: a plurality of annular spacers that are stacked on each other and position the stator blades in the axial direction; the casing that is constituted by at least two components of a cylindrical portion that is arranged to surround outer peripheries of the plurality of stacked spacers and a base portion that is attached to a lower portion of the cylindrical portion; and radial positioning portions that are provided at two vertical positions inside the cylindrical portion and coaxially hold at least a spacer of an uppermost stage and a spacer of a lowermost stage among the plurality of stacked spacers.

According to the configuration, at least both the spacer of the uppermost stage that corresponds to the side of the inlet port and the spacer of the lowermost stage that corresponds to the side of the outlet port are positioned in the axial direction and a radial (thrust) direction by the positioning portions inside the cylindrical portion when the cylindrical portion of the casing is put on the plurality of spacers arranged in multiple stages that are obtained by alternately stacking the stator blades and the rotor blades on each other to surround the outer peripheries of the spacers. That is, movement or inclination in the radial direction of the whole of the spacers arranged in multiple stages is prevented by the positioning of the two vertical spacers arranged in multiple stages. Thus, even if processing accuracy (tolerance) in the manufacturing of the casing and the spacers is slightly loosened, certain positioning accuracy is securable since the movement or inclination in the radial direction is prevented (reduced). Therefore, the manufacturing of the casing and the spacers is facilitated, and a reduction in a manufacturing cost is allowed.

In the vacuum pump according to the above aspect, an upper radial positioning portion of an inner peripheral surface of the cylindrical portion is provided corresponding to outer peripheral surfaces of the plurality of spacers, and a lower radial positioning portion of the inner peripheral surface of the cylindrical portion is provided corresponding to a lateral surface of the base portion.

According to the configuration, when the cylindrical portion of the casing is put on the plurality of spacers arranged in multiple stages that are obtained by alternately stacking the stator blades and the rotor blades on each other to surround the outer peripheries of the spacers, the spacers arranged in multiple stages are positioned in the axial direction and the radial direction by the upper positioning portion of the inner peripheral surface of the cylindrical portion that is provided on the side of the inlet port that corresponds to an upper side. On the other hand, the spacers on the side of the outlet port that corresponds to a lower side are positioned in the axial direction and the radial direction together with the base when the lower positioning portion inside the cylindrical portion comes into contact with the lateral surface of the base. Accordingly, also in this case, the movement or inclination in the radial direction of the whole of the spacers arranged in multiple stages is prevented by the positioning of the two vertical spacers in the axial direction and the radial direction. Thus, even if processing accuracy (tolerance) in the manufacturing of the casing and the spacers is slightly loosened, certain positioning accuracy is securable. Therefore, the manufacturing of the casing and the spacers is facilitated, and a reduction in a manufacturing cost is allowed.

In the vacuum pump according to the above aspect, the upper radial positioning portion is provided corresponding to an outer peripheral surface of the spacer of the uppermost stage.

According to the configuration, when the casing is put from the side of the inlet port of the spacers to surround the outer peripheries of the spacers, both the spacer of the uppermost stage that corresponds to the side of the inlet port and the spacer on the side of the outlet port that corresponds to a lower side among the plurality of spacers arranged in multiple stages that are obtained by stacking the stator blades and the rotor blades on each other are positioned in the axial direction and the radial direction by the upper radial positioning portion provided in the casing. Thus, it is possible to further loosen processing accuracy (tolerance) in the manufacturing of the casing and the spacers.

In the vacuum pump according to the above aspect, each of the plurality of spacers includes a radial supporting portion that is disposed between an outer peripheral surface of each of the stator blades and an inner peripheral surface of the cylindrical portion and a spacer portion that is provided to be opposed to an outer peripheral side of each of the rotor blades and fitted and connected to an inner peripheral surface of the radial supporting portion of each of the plurality of stacked spacers adjacent to each other.

According to the configuration, the stator blades and the rotor blades are sequentially arranged on the spacers of a lower stage that come into contact with the inner peripheral surface of the cylindrical portion, and the spacers of an upper stage are further arranged. Thus, the stator blades, the spacers, and the rotor blades may be alternately arranged in multiple stages.

In the vacuum pump according to the above aspect, the spacer of the uppermost stage includes an upper radial supporting portion that is disposed between an outer peripheral surface of a stator blade of an uppermost stage and the inner peripheral surface of the cylindrical portion, a lower radial supporting portion that is disposed between an outer peripheral surface of a stator blade that is disposed under the stator blade of the uppermost stage and the inner peripheral surface of the cylindrical portion, and a spacer portion that is provided on an outer peripheral side of a second-highest rotor blade and connects the upper radial supporting portion and the lower radial supporting portion to each other.

According to the configuration, the spacer of the uppermost stage also serves as a structure to position two vertical adjacent stator blades, that is, the stator blade of the uppermost stage and the stator blade that is disposed under the stator blade of the uppermost stage. Therefore, the entire number of the spacers may be reduced. As a result, a further cost reduction is allowed.

In the vacuum pump according to the above aspect, the spacer of the uppermost stage has a radial positioning portion that is provided to be opposed to a stator blade of an uppermost stage and an outer peripheral side of a rotor blade of an uppermost stage.

According to the configuration, the spacer of the uppermost stage is integrated with the radial positioning portion provided to be opposed to the stator blade and the outer peripheral side of the rotor blade of the uppermost stage. Therefore, the stator blade of the uppermost stage may not be separately formed. As a result, a further cost reduction is allowed.

In the vacuum pump according to the above aspect, the base portion includes a cylindrical base portion that extends to an upper side in the axial direction of the casing and has an outer peripheral surface that comes into contact with an inner surface of the lower radial positioning portion and a horizontal base portion that extends in a flange shape from an outer periphery of a lower portion of the cylindrical base portion to the outside and comes into contact with a lower surface of the cylindrical portion, and an O-ring that seals a place between the base portion and the cylindrical portion is disposed between the horizontal base portion and the lower surface of the cylindrical portion.

According to the configuration, the O-ring for sealing is disposed between the horizontal base portion and the lower surface of the cylindrical portion. Thus, the lower radial positioning portion easily comes into contact with the peripheral surface of the cylindrical base portion. As a result, an improvement in positioning accuracy is allowed.

Another aspect of the embodiments provides a cylindrical portion of a vacuum pump including a turbomolecular mechanism having an inlet port for sucking gas from an outside, an outlet port for exhausting the sucked gas to the outside, rotor blades and stator blades that are alternately arranged in multiple stages in an axial direction, and a plurality of annular spacers that are stacked on each other and position the stator blades in the axial direction, wherein the cylindrical portion is arranged to surround outer peripheries of the plurality of stacked spacers and includes radial positioning portions that are provided at two vertical positions of an inner peripheral surface of the cylindrical portion and coaxially hold at least a spacer of an uppermost stage and a spacer of a lowermost stage among the plurality of stacked spacers.

According to the configuration, the shape of the casing may be changed to be capable of supporting the plurality of spacers arranged in multiple stages that are obtained by alternately stacking the stator blades and the rotor blades on each other according to a change in the specifications of the vacuum pump. Thus, time and effort for designing/cleaning the spacers or the like and stock management may be reduced.

Another aspect of the embodiments provides a base portion of a vacuum pump including a turbomolecular mechanism having an inlet port for sucking gas from an outside, an outlet port for exhausting the sucked gas to the outside, rotor blades and stator blades that are alternately arranged in multiple stages in an axial direction, and a plurality of annular spacers that are stacked on each other and position the stator blades in the axial direction, wherein the base portion is attached to a lower portion of a cylindrical portion arranged to surround outer peripheries of the plurality of stacked spacers and positioned in a radial direction with respect to the cylindrical portion.

According to the configuration, the shape of the base portion may be changed to be capable of supporting the plurality of spacers arranged in multiple stages that are obtained by alternately stacking the stator blades and the rotor blades on each other according to a change in the specifications of the vacuum pump. Thus, time and effort for designing/cleaning the spacers or the like and stock management may be reduced.

According to the present invention, both a spacer on the side of an inlet port that corresponds to an upper side and a spacer on the side of an outlet port that corresponds to a lower side are positioned in an axial direction and a radial direction by positioning portions provided in a casing when the casing is put on a plurality of spacers arranged in multiple stages that are obtained by alternately stacking stator blades and rotor blades on each other to surround the outer peripheries of the spacers. Therefore, a movement amount or an inclination amount in the radial direction of the whole of the spacers arranged in multiple stages is suppressed (reduced). Thus, even if processing accuracy (tolerance) in the manufacturing of the casing and the spacers is slightly loosened, certain positioning accuracy is securable. Therefore, the manufacturing or the like of the casing and the spacers is facilitated, and a reduction in a manufacturing cost is allowed.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DETAILED DESCRIPTION

In order to achieve the object of providing a vacuum pump having a structure that allows the securement of the certain positioning accuracy of spacers and a reduction in a manufacturing cost for a vacuum pump even if a dimensional tolerance in manufacturing is slightly loosened, a cylindrical portion used in the vacuum pump, and a base portion, the present invention realizes a vacuum pump including a turbomolecular mechanism having rotor blades and stator blades that are alternately arranged in multiple stages in an axial direction inside a casing having an inlet port for sucking gas from an outside and an outlet port for exhausting the sucked gas to the outside, the vacuum pump including: a plurality of annular spacers that are stacked on each other and position the stator blades in the axial direction; the casing that is constituted by at least two components of a cylindrical portion that is arranged to surround outer peripheries of the plurality of stacked spacers and a base portion that is attached to a lower portion of the cylindrical portion; and radial positioning portions that are provided at two vertical positions inside the cylindrical portion and coaxially hold at least a spacer of an uppermost stage and a spacer of a lowermost stage among the plurality of stacked spacers.

Hereinafter, embodiments for carrying out the present invention will be described in detail on the basis of the accompanying drawings. Note that the same elements will be denoted by the same symbols throughout the entire description of the embodiments. Further, expressions showing directions such as a top-bottom direction and a left-right direction are not absolute but are appropriate when the respective portions of a vacuum pump according to the present invention take postures drawn in the figures. However, the expressions should be interpreted in different ways according to the changes of the postures when the postures are changed.

EMBODIMENTS

Figure 1:
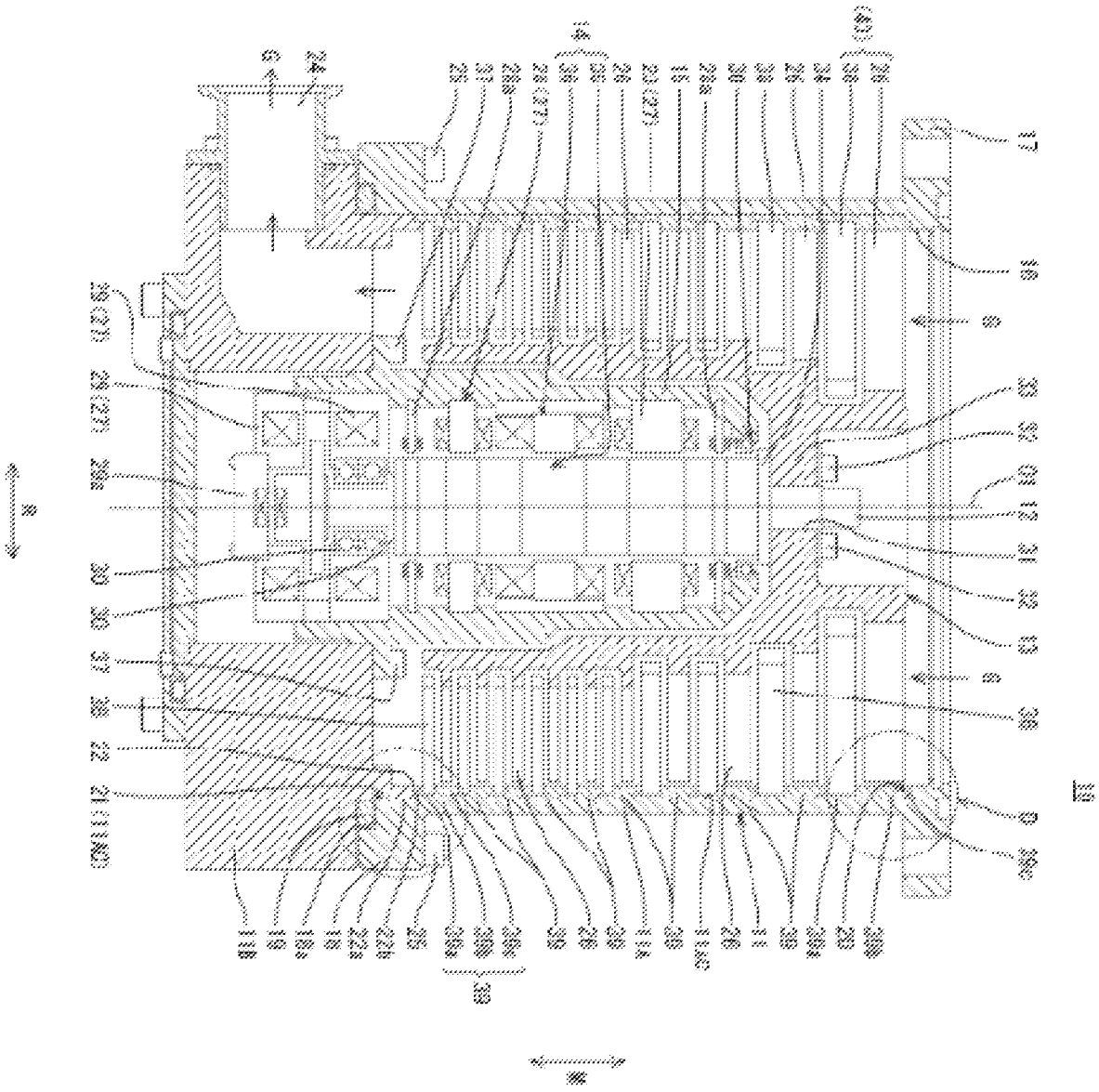
FIG. 1 is a vertical cross-sectional view of a vacuum pump shown as an embodiment of the present invention.
Figure 2A:
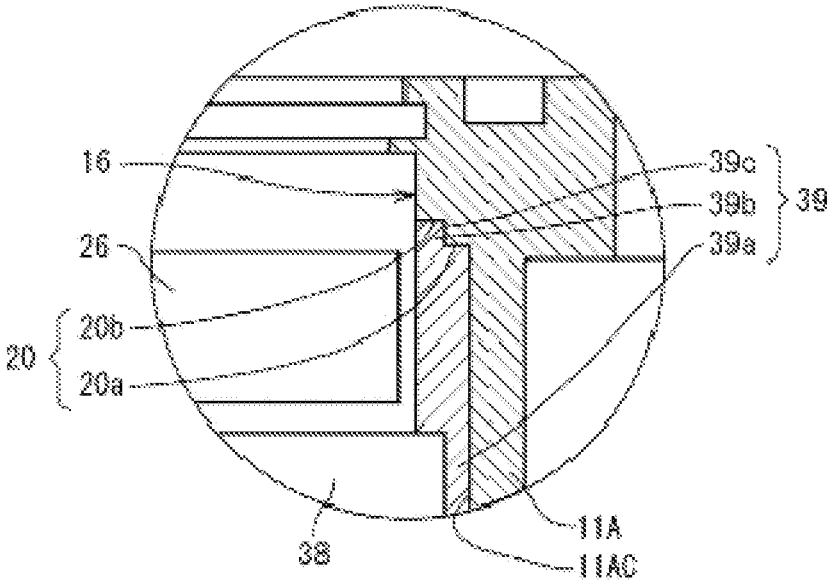
FIGS. 2A and 2B are enlarged views of FIG. 1, FIG. 2A being an enlarged view of a D-portion shown in FIG. 1, FIG. 2B being an enlarged view of an E-portion shown in FIG. 1.
Figure 2B:
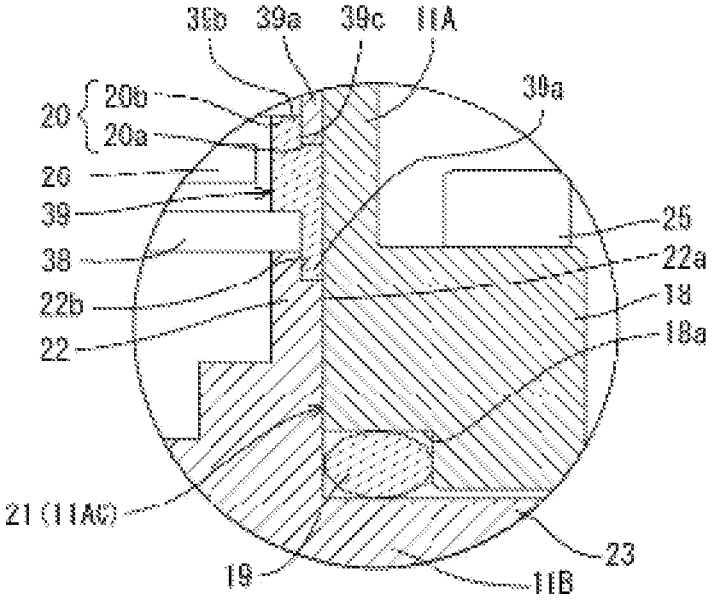
Figure 3:
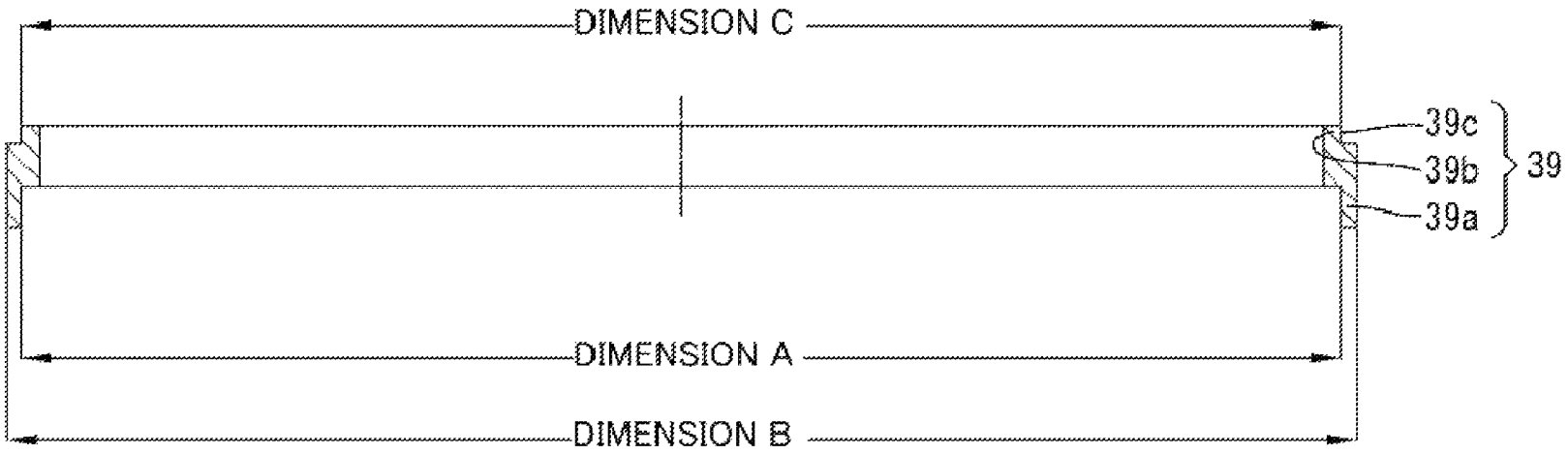
FIG. 3 is a cross-sectional view of a spacer in the vacuum pump shown in FIG. 1.

FIG. 1 is a vertical cross-sectional view of a vacuum pump 10 shown as an embodiment of the present invention. FIGS. 2A and 2B are partially-enlarged views of FIG. 1. FIG. 2A is an enlarged view of a D-portion shown in FIG. 1. FIG. 2B is an enlarged view of an E-portion shown in FIG. 1.

In FIG. 1, the vacuum pump 10 includes a casing 11 that forms the housing of the vacuum pump 10, a rotor 13 that has a rotor shaft 12 rotatably supported inside the casing 11, a driving motor 14 that rotates the rotor shaft 12, and a stator column 15 that accommodates a portion of the rotor shaft 12 and the driving motor 14.

The casing 11 has a cylindrical portion 11A and a base 11B provided beneath the cylindrical portion 11A and forms the enclosure of the vacuum pump 10.

The cylindrical portion 11A of the casing 11 is formed as a cylindrical body having openings on its upper and lower sides and uses its upper opening as a gas inlet port 16. Further, an upper flange portion 17 is integrally formed on the outer periphery of the upper opening, and a lower flange portion 18 is integrally formed on the outer periphery of the lower opening. Further, an annular recessed portion 18*a* for an O-ring that positions and arranges an O-ring 19 for sealing is formed on the lower surface of the lower flange portion 18. On the other hand, an upper radial positioning portion (also called an "upper positioning portion") 20 is provided at the upper portion of the cylindrical portion 11A, and a lower radial positioning portion (also called a "lower positioning portion") 21 is provided at the lower portion of the cylindrical portion 11A on the inner peripheral surface side of the cylindrical portion 11A.

The upper radial positioning portion 20 includes a first annular wall portion 20*a* that horizontally protrudes to an inner side from an inner peripheral surface 11AC of the cylindrical portion 11A and a second annular wall portion 20*b* that is perpendicularly recessed toward an upper side from the inner surface of the first annular wall portion 20*a* and horizontally protrudes to the inner side from its recessed position.

The lower radial positioning portion 21 uses a portion of the inner peripheral surface 11AC, that is, a lower inner peripheral surface in the cylindrical portion 11A.

The base 11B of the casing 11 integrally has a cylindrical base portion 22 that extends to an upper side in the axial direction of the casing 11 and has an outer peripheral surface 22*a* fitted and connected to the inner surface (inner peripheral surface 11AC) of the lower radial positioning portion 21 of the cylindrical portion 11A and a horizontal base portion 23 that horizontally extends in a flange shape toward an outer side from the lower periphery of the cylindrical base portion 22 and has an annular shape to come into contact with the lower surface of the lower flange portion 18 in the cylindrical portion 11A. Note that a small-diameter portion 22*b* to which the lower portion of a first radial supporting portion 39*a* of an annular spacer 39 that will be described later is attached is provided at the upper portion of the cylindrical base portion 22.

Then, when the cylindrical base portion 22 and the cylindrical portion 11A are fitted to each other from the lower end of the cylindrical portion 11A, the casing 11 is connected to the base 11B with the cylindrical portion 11A placed on the base 11B as shown in FIG. 1. Further, in this connection, an O-ring 19 for sealing is interposed between the lower flange portion 18 and the horizontal base portion 23, and the lower flange portion 18 and the horizontal base portion 23 are fixed to each other by bolts 25. Thus, the cylindrical portion 11A and the base 11B are integrated with each other.

The rotor 13 includes a rotor shaft 12 and rotor blades 26 that are fixed to the upper portion of the rotor shaft 12 and concentrically arranged in parallel with respect to an axial line O1 of the rotor shaft 12. In the present embodiment, the rotor blades 26 of ten stages are provided.

The rotor blades 26 include blades inclined at a prescribed angle and are integrated with the upper outer peripheral surface of the rotor 13. Further, the rotor blades 26 are radially provided at a plurality places about the axial line O1 of the rotor 13.

The rotor shaft 12 is supported by magnetic bearings 27 in a non-contact manner. The magnetic bearings 27 include radial electromagnets 28 and axial electromagnets 29. The radial electromagnets 28 and the axial electromagnets 29 are connected to a controlling unit not shown.

The controlling unit controls exciting currents for the radial electromagnets 28 and the axial electromagnets 29 on the basis of values detected by the radial displacement sensors 28*a* and an axial displacement sensor 29*a*. Thus, the rotor shaft 12 is supported in a floating state at a prescribed position.

The upper and lower portions of the rotor shaft 12 are inserted into touchdown bearings 30. When the rotor shaft 12 becomes uncontrollable, the rotor shaft 12 that rotates at a high speed comes into contact with the touchdown bearings 30 to prevent excessive damage inside the vacuum pump 10.

The rotor 13 is integrally attached to the rotor shaft 12 in such a manner that bolts 32 are inserted into a rotor flange 33 and screwed into a shaft flange 34 with the upper portion of the rotor shaft 12 inserted into a boss hole 31. Hereinafter, the axial direction of the rotor shaft 12 will be called an "axial direction M," and the radial direction thereof will be called a "radial direction R."

The driving motor 14 includes a rotor 35 that is attached to the outer periphery of the rotor shaft 12 and a stator 36 that is arranged to surround the rotor 35. The stator 36 is connected to the above controlling unit not shown, and the rotation of the rotor 13 is controlled by the controlling unit.

The stator column 15 is fixed to the base 11B via bolts 37 in a state of being placed on the base 11B.

Stator blades 38 are provided near the rotor blades 26 in the axial direction. That is, the rotor blades 26 and the stator blades 38 are arranged alternately and in multiple stages along the axial direction M. In the present embodiment, the stator blades 38 of ten stages are provided.

The stator blades 38 are formed into an annular shape and include blades that are inclined in a direction opposite to the direction of the rotor blades 26 and rings that are connected to both ends of the blades. The stator blades 38 are held by spacers 39 stacked on each other on the inner peripheral surface of the cylindrical portion 11A of the casing 11 and positioned in the axial direction M and the radial direction R. Further, the blades of the stator blades 38 are radially provided at a plurality of places about the axial line O1 of the rotor 13.

Further, a gas outlet port 24 that is in communication with the outside is provided on the outer peripheral surface of the cylindrical base portion 22 of the base 11B. The gas outlet port 24 is connected so as to communicate with an auxiliary pump not shown. On the basis of the mutual action between the rotor blades 26 and the stator blades 38, the vacuum pump 10 transfers gas (air) G sucked in from the gas inlet port 16 from an upper side to a lower side in the axial direction M and exhausts the same to the outside from the gas outlet port 24.

The stator blade 38 of the lowermost stage is placed on the small-diameter portion 22*b* of the cylindrical base portion 22 in the base 11B. Specifically, the base end of the stator blade 38 is held by the cylindrical base portion 22, the upper surface of the small-diameter portion 22*b*, and the spacer 39 to be supported in the axial direction M and the radial direction R.

The spacers 39 are stator members having a substantially cylindrical shape and extend along the axial direction of the casing 11. The spacers 39 include first radial supporting portions 39*a* that orbit and oppose the outer peripheral surfaces of the stator blades 38 and oppose the inner peripheral surface 11AC of the cylindrical portion 11A with a slight gap placed therebetween and second radial supporting portions 39*b* that orbit and oppose the outer peripheral surfaces of the rotor blades 26 and come into contact with the inner peripheral surfaces of the first radial supporting portions 39*a*. Further, small-diameter portions (step portions) 39*c* to which the lower portions of the first radial supporting portions 39*a* of the spacers 39 that are sequentially stacked on an upper side are attached are formed on the outer peripheries of the second radial supporting portions 39*b*.

Note that a recessed amount in the radial direction of the small-diameter portions 39*c* in the spacers 39 is substantially equal to a thickness in the radial direction of the first radial supporting portions 39*a* and set so that the outer peripheral surfaces of the spacers 39 stacked on an upper side and the outer peripheral surfaces of the spacers 39 on a lower side are flush with each other when the lower portions of the first radial supporting portions 39*a* of the spacers 39 stacked on the upper side are attached to the small-diameter portions 39*c*. On the other hand, a recessed amount in the radial direction on the inner peripheral surface side of the first radial supporting portions 39*a* in the spacers 39 is substantially equal to a thickness in the radial direction of the second radial supporting portions 39*b* and set so that the inner peripheral surfaces of the spacers 39 stacked on an upper side and the inner peripheral surfaces of the spacers 39 on a lower side are substantially flush with each other when the upper portions of the second radial supporting portions 39*b* stacked on the lower side spacer 39 are attached to the first radial supporting portions 39*a*. Further, a height in the axial direction of the respective spacers 39 is arbitrarily set in proportion to the heights (thicknesses) of the blades of the rotor blades 26 and the stator blades 38.

Then, in the assembling of the stator blades 38 and the spacers 39 of the vacuum pump 10, the stator blade 38 of the lowermost stage is first placed on the small-diameter portion 22*b* of the cylindrical base portion 22 in the base 11B after the rotor 13 that serves as a rotating portion is installed on the base 11B, and the spacer 39 of the lowermost stage is next stacked on the stator blade 38 of the lowermost stage. At this time, the spacer 39 of the lowermost stage is attached in a state of enclosing the stator blade 38 of the lowermost stage and the small-diameter portion 22*b* inside the first radial supporting portion 39*a*. Thus, the small-diameter portion 22*b* and the first radial supporting portion 39*a* are fitted and connected to each other to position the spacer 39 of the lowermost stage with respect to the base 11B. Further, when the spacer 39 of the lowermost stage is arranged, the rotor blade 26 of the lowermost stage is enclosed by this spacer 39 in a non-contact state.

Next, the stator blade 38 of the second stage is placed on the second radial supporting portion 39*b* of the spacer 39 of the last stage, and then the spacer 39 of the second stage is stacked on the stator blade 38 of the second stage. At this time, the spacer 39 of the second stage is attached in a state of enclosing the stator blade 38 of the second stage and the second radial supporting portion 39*b* of the spacer 39 of the lowermost stage inside the first radial supporting portion

39*a*. The second radial supporting portion 39*b* of the spacer 39 of the lowermost stage and the first radial supporting portion 39*a* of the spacer 39 of the second stage are fitted and connected to each other to position the spacer 39 of the second stage with respect to the spacer 39 of the lowermost stage. Further, when the spacer 39 of the second stage is arranged, the rotor blade 26 of the last stage is enclosed by the spacer 39 in a non-contact state. When the above operation is repeatedly performed, a gas transfer mechanism 40 having the cylindrical stator portion and the rotor portion in which the rotor blades 26 and the stator blades 38 are alternately arranged in multiple stages in the axial direction is assembled and formed.

After the assembling of the stator blades 38 and the spacers 39, the casing 11 is put from above the side of the spacer 39 of the uppermost stage. Thus, the gas transfer mechanism 40 is accommodated in the casing 11. Note that in the operation of accommodating the gas transfer mechanism 40 in the casing 11, the casing 11 is dropped using the gas transfer mechanism 40 as a guide in a state in which the spacer 39 of the uppermost stage is inserted from the lower opening of the cylindrical portion 11A. At this time, the casing 11 is dropped with the inner peripheral surface 11AC of the cylindrical portion 11A sliding against the outer peripheral surfaces of the spacers 39. Then, when the casing 11 is dropped into a position right before its final position, the lower radial positioning portion 21 that is provided on the inner peripheral surface 11AC of the cylindrical portion 11A comes into contact with the outer peripheral surface 22*a* of the cylindrical base portion 22 and the lower side of the gas transfer mechanism 40 is positioned with respect to the base 11B. Further, when the casing 11 is dropped into its substantially final position, the upper radial positioning portion 20 provided on the inner peripheral surface 11AC of the cylindrical portion 11A corresponds to the spacer 39 of the uppermost stage. Thus, the upper portion of the spacer 39 of the uppermost stage is fitted and connected to the first annular wall portion 20*a* and the second annular wall portion 20*b*, and the upper side of the gas transfer mechanism 40 is positioned with respect to the casing 11. That is, the two vertical positions of the gas transfer mechanism 40 are positioned by the upper radial positioning portion 20 and the lower radial positioning portion 21, and the movement or inclination in the radial direction R of the whole of the spacers 39 arranged in multiple stages is prevented (reduced).

In the vacuum pump 10 thus configured, the upper flange portion 17 of the casing 11 that has the gas inlet port 16 as described above is attached to a vacuum container such as a chamber not shown, and the auxiliary pump not shown is attached to the gas outlet port 24 that is provided on the base 11B. When the driving motor 14 of the vacuum pump 10 is driven in this state, the rotor blades 26 rotate at a high speed together with the rotor 13. Thus, gas G from the gas inlet port 16 is flowed into the vacuum pump 10, sequentially transferred inside the gas transfer mechanism 40, and exhausted from the gas outlet port 24 of the base 11B. That is, the inside of the vacuum container is evacuated.

Accordingly, the vacuum pump 10 of this embodiment is so structured that the two vertical positions of the gas transfer mechanism 40 are positioned by the upper radial positioning portion 20 and the lower radial positioning portion 21 and the movement or inclination in the radial direction of the whole of the spacers 39 arranged in multiple stages is prevented. Therefore, the movement or inclination in the radial direction R of the whole of the spacers 39 arranged in multiple stages is prevented (reduced). Thus, even if processing accuracy (tolerance) in the manufacturing of the casing 11 and the spacers 39 is slightly loosened, certain positioning accuracy is securable. Therefore, the manufacturing or the like of the casing 11 and the spacers 39 is facilitated. As a result, a reduction in a manufacturing cost is allowed. Note that in conventional structures in which only the upper position of a gas transfer mechanism is positioned, the respective tolerances of a dimension A of the inner peripheries of first radial supporting portions, a dimension B of the outer peripheries of spacers, and a dimension C of the outer peripheries of small-diameter portions (step portions) are requested to be small and tightened. Compared with the conventional structures, the present invention makes it possible to loosen the tolerances by about 30%. Therefore, processing is simplified, and a reduction in a manufacturing cost is allowed.

Figure 4:
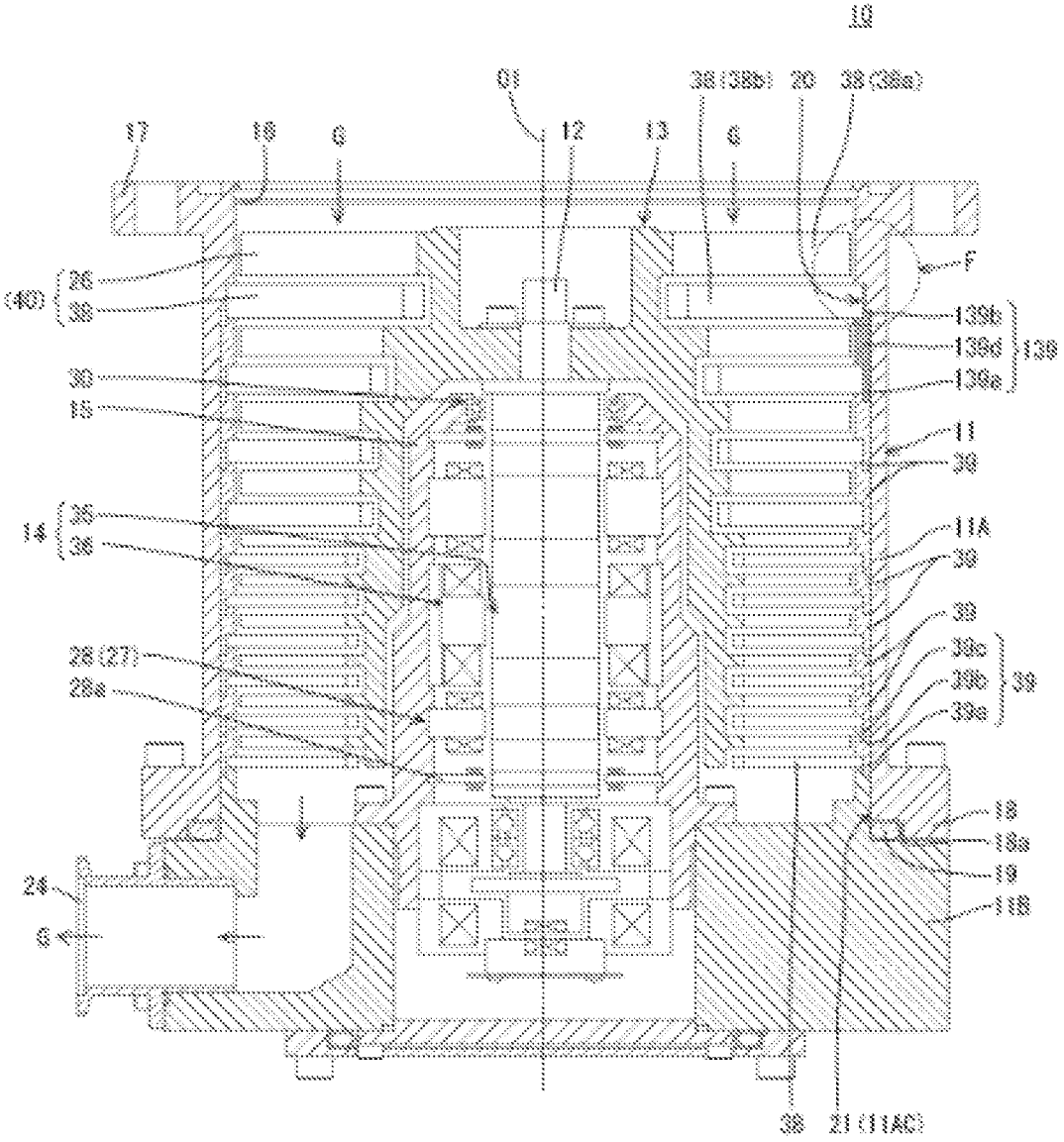
FIG. 4 is a vertical cross-sectional view of a vacuum pump shown as a first modified example of the present invention.
Figure 5:
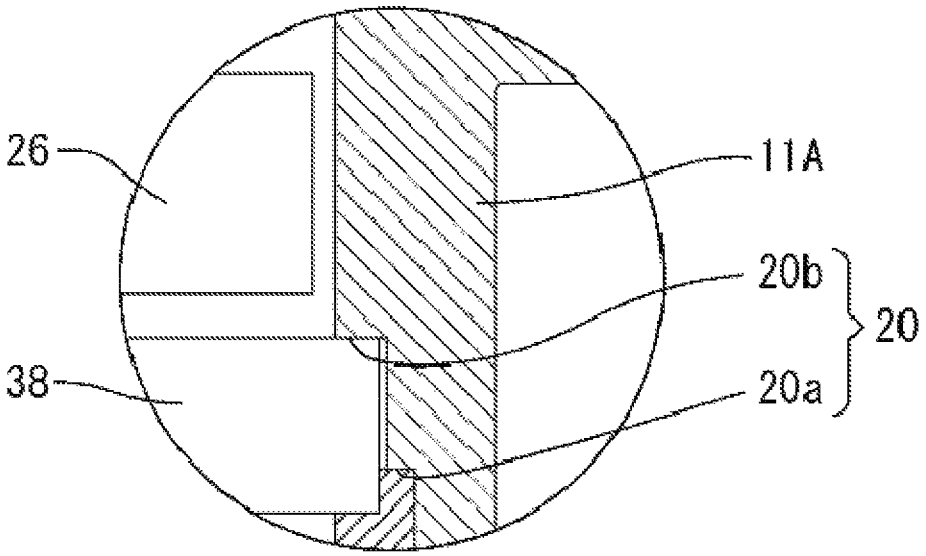
FIG. 5 is an enlarged view of an F-portion shown in FIG. 4.

FIG. 4 is a vertical cross-sectional view of a vacuum pump 10 shown as a first modified example of the vacuum pump shown in FIG. 1. In the first modified example shown in FIG. 4, a spacer 139 of the uppermost stage is deformed, and the other configurations are the same as those of the vacuum pump 10 shown in FIG. 1 and FIGS. 2A and 2B. Therefore, the same constituting portions will be denoted by the same symbols, and their duplicated descriptions will be omitted.

The annular spacer 139 of the uppermost stage shown in FIG. 4 is arranged on the outer peripheral surface of a stator blade 38(38*a*) of the uppermost stage, the outer peripheral surface of a stator blade right under the stator blade 38*a* of the uppermost stage, that is, a stator blade 38(38*b*) of the second-highest stage, and the outer peripheral surface of a rotor blade 26*a* of the second-highest stage. The spacer 139 of the uppermost stage includes a spacer portion 139*d* that holds an interval in an axial direction between the stator blade 38(38*a*) of the uppermost stage and the stator blade 38(38*b*) of the second-highest stage, a first radial supporting portion 139*a* that vertically extends from the outer peripheral edge of the lower surface of the spacer portion 139*d* to a lower side in the axial direction and serves as a lower radial supporting portion, and a second radial supporting portion 139*b* that vertically extends from the outer peripheral edge of the upper surface of the spacer portion 139*d* to an upper side in the axial direction and serves as an upper radial supporting portion.

Then, in a state of enclosing the stator blade 38*b* of the second-highest stage with the first radial supporting portion 139*a* and enclosing the rotor blade 26 of the second-highest stage with the spacer portion 139*d*, the spacer 139 of the uppermost stage is fitted and connected to a small-diameter portion (step portion) 139*c* of a spacer 39 of the second-highest stage. Thus, the spacer 139 of the uppermost stage is stacked on the spacer 39 of the second-highest stage to be positioned. After that, a stator blade 38*a* of the uppermost stage is placed on the upper surface of the spacer portion 139*d* of the spacer 139 of the uppermost stage, and then a cylindrical portion 11A of a casing 11 is put on the spacers 139.

Further, in a state in which the cylindrical portion 11A is put on the spacers 139, an upper radial positioning portion 20 provided on the inner peripheral surface 11AC of the cylindrical portion 11A corresponds to the spacer 139 of the uppermost stage, the upper portion of the spacer 139 of the uppermost stage comes into contact with and fits into a first annular wall portion 20*a*, and the upper surface of the spacer 139 of the uppermost stage comes into contact with a second annular wall portion 20*b*. Thus, the upper side of a gas transfer mechanism 40 is positioned with respect to the casing 11. On the other hand, a lower radial positioning portion 21 of the casing 11 comes into contact with an outer peripheral surface 22*a* of the cylindrical base portion 22 and positions the lower side of the gas transfer mechanism 40 with respect to the base 11B.

Accordingly, also in the vacuum pump 10 shown as the first modified example, the two vertical positions of the gas transfer mechanism 40 are positioned by the upper radial positioning portion 20 and the lower radial positioning portion 21, and the movement or inclination in a radial direction of the whole of the spacers 39 arranged in multiple stages is prevented. Thus, the structure of this modified example makes it possible to save space to orbit and oppose the rotor blade 26 of the uppermost stage and reduce a manufacturing cost since the number of components of the vacuum pump 10 of this modified example is smaller than that of the vacuum pump 10 shown in FIG. 1.

Figure 6:
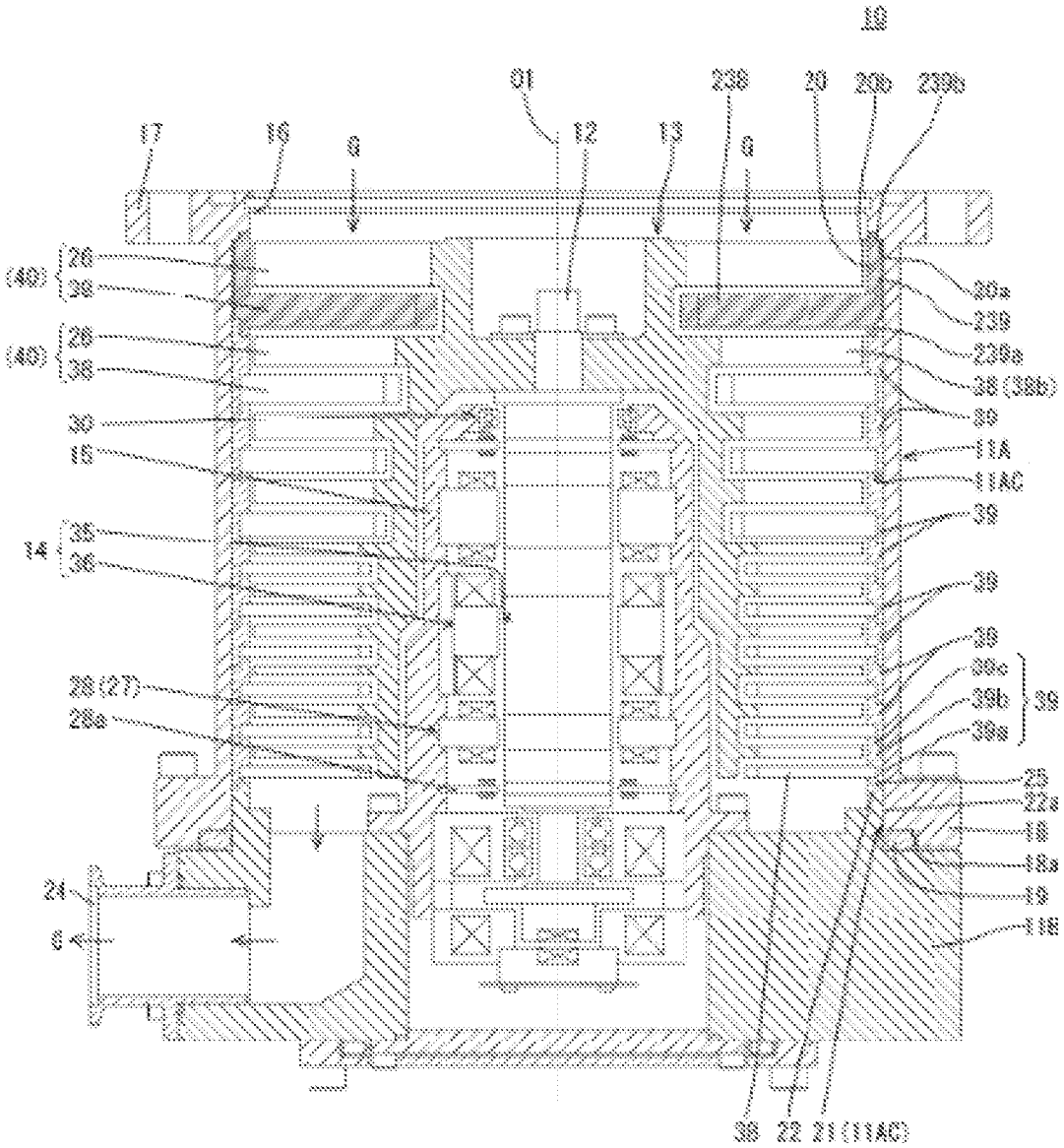
FIG. 6 is a vertical cross-sectional view of a vacuum pump shown as a second modified example of the present invention.
Figure 7:
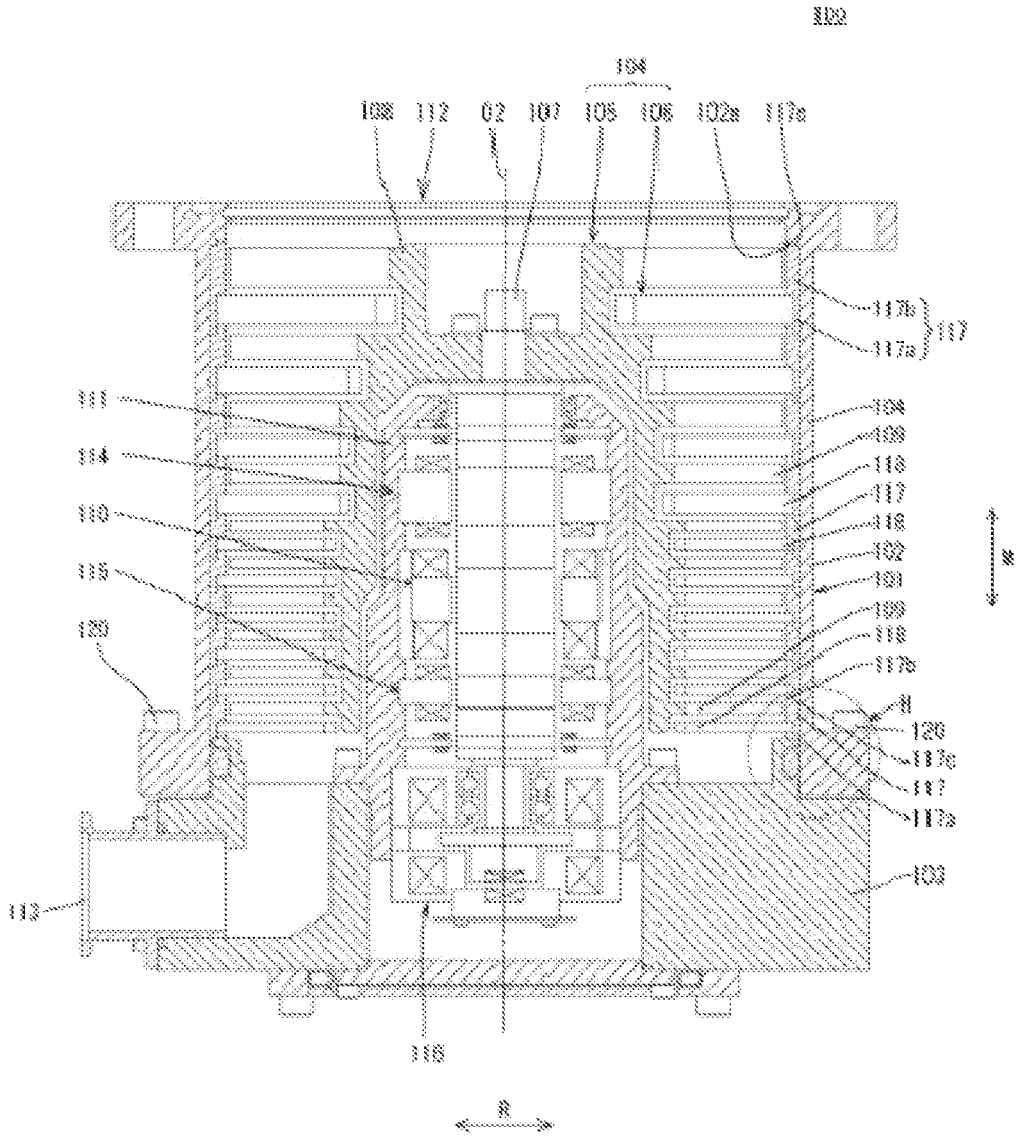
FIG. 7 (PRIOR ART)
FIG. 7 is a vertical cross-sectional view showing a conventional vacuum pump.
Figure 8:
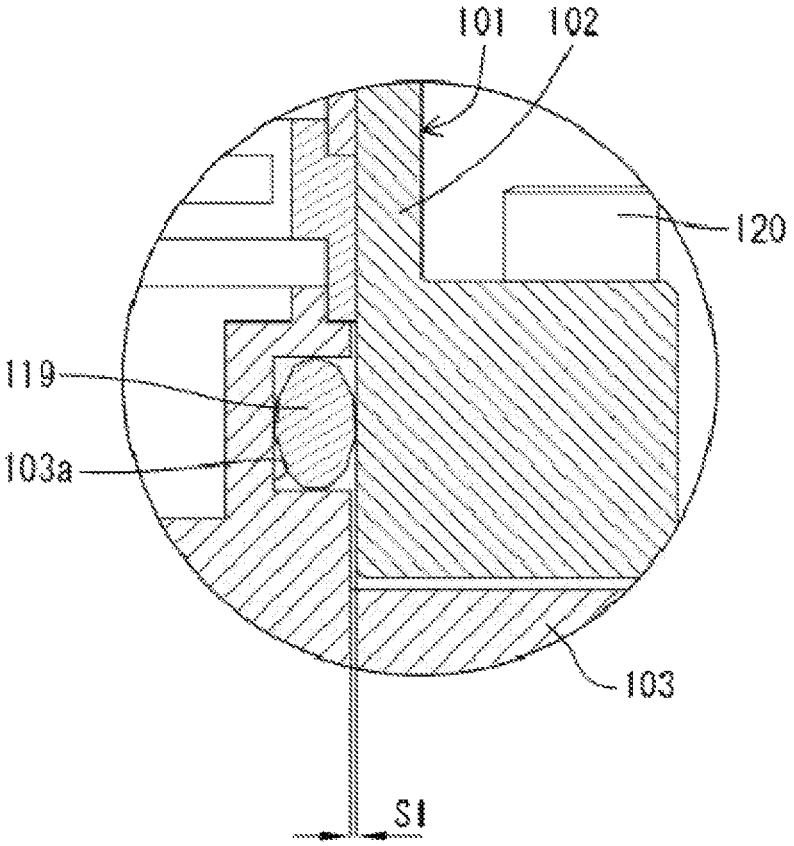
FIG. 8 (PRIOR ART)
FIG. 8 is an enlarged view of an H-portion shown in FIG. 7.
Figure 9:
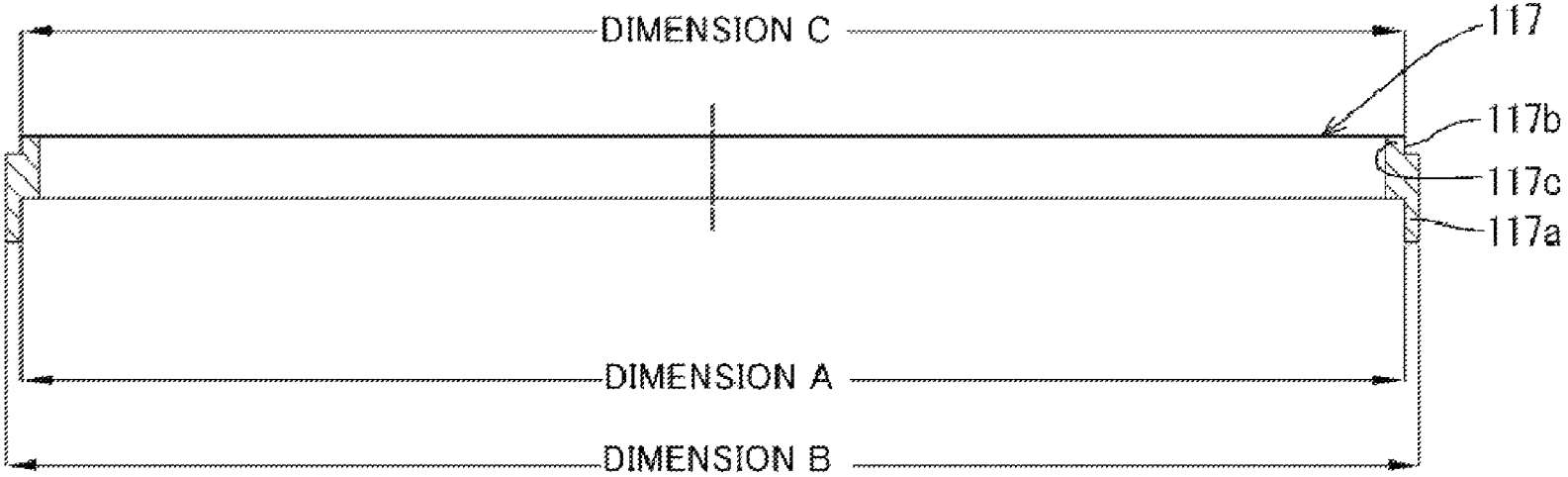
FIG. 9 is an enlarged cross-sectional view of a spacer in the conventional vacuum pump shown in FIG. 7.

FIG. 6 is a vertical cross-sectional view of a vacuum pump 10 shown as a second modified example of the vacuum pump shown in FIGS. 1, 2A and 2B. In the second modified example shown in FIG. 6, a spacer 239 of the uppermost stage is integrated with a stator blade 238 of the uppermost stage, and the other configurations are the same as those of the vacuum pump 10 shown in FIG. 1 and FIGS. 2A and 2B. Therefore, the same constituting portions will be denoted by the same symbols, and their duplicated descriptions will be omitted.

The annular spacer 239 of the uppermost stage shown in FIG. 6 is an annular member and integrated with the stator blade 238 of the uppermost stage that extends substantially horizontally from the inner peripheral surface of the spacer 239 of the uppermost stage to an axial line O1. Further, a first radial supporting portion 239*a* that is fitted and connected to a second radial supporting portion 39*b* of a spacer 39 of the second-highest stage is provided at the lower portion of the spacer 239, and a second radial supporting portion 239*b* that comes into contact a first annular wall portion 20*a* and a second annular wall portion 20*b* of an upper radial positioning portion 20 to be positioned and engaged and serves as a radial positioning portion is provided at the upper portion of the spacer 239.

Further, in a state of enclosing a rotor blade 26 of the uppermost stage with the second radial supporting portion 239*b*, the spacer 239 of the uppermost stage makes the first radial supporting portion 239*a* fitted and connected to a small-diameter portion (step portion) 39*c* of the spacer 39 of the second-highest stage. Thus, the spacer 239 of the uppermost stage is stacked on the spacer 39 of the second-highest stage to be positioned. After that, a cylindrical portion 11A of a casing 11 is put on the spacers.

Further, in a state in which the cylindrical portion 11A of the casing 11 is put on the spacers, the upper radial positioning portion 20 provided on an inner peripheral surface 11AC of the cylindrical portion 11A corresponds to the spacer 239 of the uppermost stage. The upper portion of the spacer 239 of the uppermost stage is fitted and connected to the first annular wall portion 20*a*, and the upper surface of the second radial supporting portion 239*b* comes into contact with the second annular wall portion 20*b*. Thus, the upper side of a gas transfer mechanism 40 is positioned with respect to the casing 11. On the other hand, a lower radial positioning portion 21 of the casing 11 comes into contact with an outer peripheral surface 22*a* of a cylindrical base portion 22 and positions the lower side of the gas transfer mechanism 40 with respect to a base 11B.

Accordingly, also in the vacuum pump 10 shown as the second modified example, the two vertical positions of the gas transfer mechanism 40 are positioned by the upper radial positioning portion 20 and the lower radial positioning portion 21, and the movement or inclination in a radial direction of the whole of the spacers 39 arranged in multiple stages is prevented. Further, the structure of this second modified example makes it possible to reduce a manufacturing cost since the spacer 239 of the uppermost stage is integrated with the stator blade 238 of the uppermost stage and thus the number of components of the vacuum pump 10 of this second modified example is smaller than that of the vacuum pump 10 shown in FIG. 1.

Note that the present invention may be modified in various ways without departing from its spirit and applied to the modifications as a matter of course.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump including a turbomolecular mechanism having rotor blades and stator blades that are alternately arranged in multiple stages in an axial direction inside a casing having an inlet port for sucking gas from an outside and an outlet port for exhausting the sucked gas to the outside, the vacuum pump comprising:

a plurality of annular spacers that are stacked on each other and position the stator blades in the axial direction;

the casing that is constituted by at least two components of a cylindrical portion that is arranged to surround outer peripheries of the plurality of stacked spacers and a base portion that is attached to a lower portion of the cylindrical portion; and an upper radial positioning portion of an inner peripheral surface of the cylindrical portion and a lower radial positioning portion of the inner peripheral surface of the cylindrical portion are provided at two vertical positions inside the cylindrical portion and coaxially hold at least a spacer of an uppermost stage and a spacer of a lowermost stage among the plurality of stacked spacers and the lower radial positioning portion of the inner peripheral surface of the cylindrical portion has an inner surface in contact with an outer peripheral surface of the base portion, wherein the spacer of the uppermost stage has an inner peripheral surface facing toward an outer peripheral surface of a second-highest rotor blade of the rotor blades.

2. The vacuum pump according to claim 1, wherein the upper radial positioning portion of the inner peripheral surface of the cylindrical portion is provided corresponding to outer peripheral surfaces of the plurality of spacers, and the lower radial positioning portion of the inner peripheral surface of the cylindrical portion is provided corresponding to a lateral surface of the base portion.

3. The vacuum pump according to claim 2, wherein the upper radial positioning portion is provided corresponding to an outer peripheral surface of the spacer of the uppermost stage.

4. The vacuum pump according to claim 1, wherein each of the plurality of spacers includes a radial supporting portion that is disposed between an outer peripheral surface of each of the stator blades and an inner peripheral surface of the cylindrical portion and a spacer portion that is provided to be opposed to an outer peripheral side of each of the rotor blades and fitted and connected to an inner peripheral surface of the radial supporting portion of each of the plurality of stacked spacers adjacent to each other.

5. The vacuum pump according to claim 1, wherein the spacer of the uppermost stage includes an upper radial supporting portion that is disposed between an outer peripheral surface of a stator blade of an uppermost stage and the inner peripheral surface of the cylindrical portion, a lower radial supporting portion that is disposed between an outer peripheral surface of a stator blade that is disposed under the stator blade of the uppermost stage and the inner peripheral surface of the cylindrical portion, and a spacer portion that connects the upper radial supporting portion and the lower radial supporting portion to each other.

6. The vacuum pump according to claim 1, wherein the spacer of the uppermost stage is integrated with a stator blade of an uppermost stage.

7. The vacuum pump according to claim 2, wherein the base portion includes a cylindrical base portion that extends to an upper side in the axial direction of the casing and has the outer peripheral surface that comes into contact with the inner surface of the lower radial positioning portion and a horizontal base portion that extends in a flange shape from an outer periphery of a lower portion of the cylindrical base portion to the outside and comes into contact with a lower surface of the cylindrical portion, wherein an O-ring that seals a place between the base portion and the cylindrical portion is disposed between the horizontal base portion and the lower surface of the cylindrical portion.

* * * * *